US005932494A

United States Patent [19]

Crippa

[11] Patent Number: 5,932,494

[45] Date of Patent: Aug. 3, 1999

[54] TEXTILE MATERIAL AS A SUPPORT FOR COAGULATION AND PRODUCT OBTAINABLE THROUGH COAGULATION OF RESINS ON SAID SUPPORT

[76] Inventor: Andrea Crippa, Via Martin Luther King 2, Biassono, Milan, Italy

[21] Appl. No.: 09/060,043

[22] Filed: Apr. 14, 1998

[30] Foreign Application Priority Data

Apr. 16, 1997 [IT] Italy ..... MI97A0879

[51] Int. Cl.[6] ..... B32B 5/02

[52] U.S. Cl. ..... 442/63; 442/189; 442/208; 442/214; 442/216; 442/220; 139/426 TW; 427/352

[58] Field of Search ..... 139/426 TW; 442/63, 442/189, 208, 214, 216, 220; 427/352

[56] References Cited

U.S. PATENT DOCUMENTS 4,286,012 8/1981 Zins et al. ..... 428/252

5,495,874 3/1996 Heiman ..... 139/420 A

FOREIGN PATENT DOCUMENTS 1 469 543 12/1968 Germany .

1 469 572 1/1969 Germany .

*Primary Examiner*—Christopher Raimund

*Attorney, Agent, or Firm*—Oblon, Spivak, McClelland, Maier & Neustadt, P.C.

[57] ABSTRACT

A textile material for use as a support for coagulation is disclosed. The textile material consists of a warp including of from 8 to 10 polyester yarns per centimeter and a weft including of from 12 to 16 cotton yarns per centimeter. The coagulated product obtainable through coagulation of polyurethane resins on the support is also disclosed.

22 Claims, 1 Drawing Sheet

TEXTILE MATERIAL AS A SUPPORT FOR COAGULATION AND PRODUCT OBTAINABLE THROUGH COAGULATION OF RESINS ON SAID SUPPORT

The present invention refers to a textile material as a support for coagulation and to the product obtainable through coagulation of polyurethane resins on said support.

Different supports are known from the state of the art, supports which can be submitted to a coagulation process that, using special polyurethane resins, allows to obtain a leather-like product. Main object of the invention is to provide a product that can substitute natural leather in all its applications, with similar aesthetic and qualitative characteristics, being however less expensive.

All the products obtained according to the known techniques present however well defined limits of application, so that they cannot completely substitute natural leather. In particular, they are not known textile supports that, through the coagulation technique, allow to obtain a coagulated product having a thickness higher than 16–18/10 of mm.

The obtained product can not clearly present the same characteristics of solidity and resistance of the natural leather.

The product according to the present invention allows to overcome the drawbacks of the existing products and in particular allows to obtain a coagulated product having a greater thickness.

It is an object of the present invention to provide a textile material, especially suitable for the preparation in continuous of a coagulation support for resins, characterized in that it consists of a warp including of from 8 to 10 polyester yarns per centimeter, these warp yarns presenting a count of 12/5 and a value of T.P.M. (Turns per meter) comprised between 200 and 220, and of a weft including of from 12 to 16 cotton yarns per centimeter, these weft yarns presenting a count of 12/6 and a value of T.P.M. comprised between 130 and 160, said textile material being further characterized in that its thickness ranges of from 1.38 mm to 1.53 mm.

Preferably, such textile material presents a warp yarn with a T.P.M. value of 207 and a weft yarn with a T.P.M. value of 157.48.

It is also an object of the present invention the use of the textile material according to the present invention as a textile support for coagulation.

It is an additional object of the present invention to provide a product obtainable through coagulation treatment with solutions based on polyurethane resins, having a polyurethane content ranging of from 25% to 38%.

In particular, the products obtainable through coagulation of said polyurethane resins on the support for coagulation according to the present invention, have a thickness varying in the range of from 2.1 mm to 2.3 mm.

The main advantage of the product according to the present invention, consists in that the product obtained through impregnation and coagulation of the textile support with high viscosity polyurethane macroresins, followed by finishing treatments with polyurethane resins, is characterised by presenting a high degree of transpiration to steam and body perspiration, by being water-proof, by an excellent resistance to solvents and to phenomena of rapid ageing (hydrolysis), phenomena which can be caused by chemical agents, by being oleo-repellent and dirt-repellent.

All the characteristics and advantages of the product according to the present invention will result in a more clear way in the following detailed and illustrative description.

In particular, with reference to the working generally known as "double panama", the present invention concerns a support for coagulation having a thickness of from 1.47 mm to 1.53 mm, and consisting of a warp including of from 8 to 10 polyester yarns per centimeter, with a count of 12/5, a value of T.P.I (Turns per inch) of 5.25, and a T.P.M. value (Turns per meter) of 207, the ultimate tensile strength of the polyester yarn being 4100 g and the ultimate elongation of the polyester yarn being 33%, and of a weft including of from 14 to 16 cotton yarns per centimeter, with a count of 12/6, a value of T.P.I. of 4 and a T.P.M. value of 157.48, the ultimate tensile strength of the cotton yarn being 3000 g and the ultimate elongation of the cotton yarn being 10%.

Figure 1:
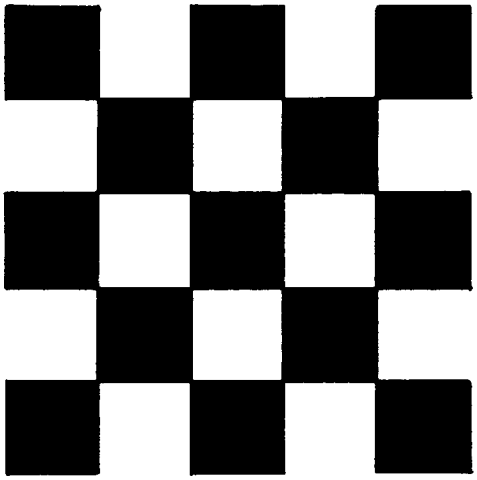
FIG. 1 depicts a textile support having a "double panama" weave pattern according to one embodiment of the invention.

As already considered, such support presents a weave pattern known as "double panama" shown in FIG. 1, it has a weight of 700 g/m$^2$ ±5% and it consists of cotton in a percentage of from 65% to 73% and of polyester in a percentage of from 35% to 27%.

In particular, said support presents mechanical characteristics having the following average values:

| | | |
|---|---|---|
| ultimate tensile strength: | warp | 300 kg/5 cm ± 10% |
| | weft | from 140 to 180 kg/5 cm ± 10% |
| % ultimate elongation: | warp | 30% ± 5% |
| | weft | 20% ± 5% |
| tearing (Kg.-F) | warp | 110 ± 5% |
| | weft | 70 ± 5% |

Furthermore, with reference to the working generally known as "herringbone 3:1", the present invention concerns a further support for coagulation having a thickness of from 1.38 mm to 1.42 mm and consisting of a warp including of from 8 to 10 polyester yarns per centimeter with a count of 12/5, a value of T.P.I. (Turns per inch) of 5.25 and a T.P.M. (Turns per meter) value of 207, the ultimate tensile strength of the polyester yarn being 4100 g and the ultimate elongation of the polyester yarn being 33%, and of a weft including of from 12 to 14 cotton yarns per centimeter, with a count of 12/6 and a value of T.P.I. of 4 and a T.P.M. value of 157.48, the ultimate tensile strength of the cotton yarn being 3000 g and the ultimate elongation of the cotton yarn being 10%.

Figure 2:
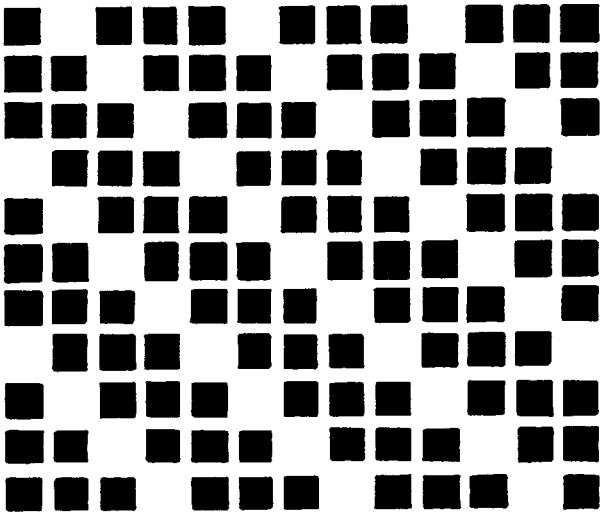
FIG. 2 depicts a textile support having a "herringbone 3:1" pattern according to another embodiment of the invention.

As already observed before, such support presents a pattern known as "herringbone 3:1" shown in FIG. 2, it has a weight of 650 g/m$^2$ ±5% and it consists of cotton in a percentage of from 61% to 71% and of polyester in a percentage of from 39% to 29%.

In particular, the previously described supports are loom-woven at industrial width varying in the range of from 150 cm to 180 cm and they are then submitted to the process of coagulation with polyurethane solutions.

Said supports present the advantage that, having a mainly natural composition, allow a high adsorption of the treatment solutions.

The polyurethane solutions to be used for the coagulation of the support, disclosed in the following, are selected according to the characteristics of the product to be obtained, using polyurethanes known as Vithane 182, Vithane 160 and Vithane 168, produced and commercialised by Morton S.p.A.

They are polyurethane solutions having an extremely high final viscosity and a content of dry substance (polyurethane) ranging of from 25% to 38%.

Therefore, three different basic solutions have been prepared, containing respectively the polyurethane resins Vithane 182, 160 or 168.

The solution A (obtained from the base Vithane 182), having a 25% of dry substance (polyurethane), presents the following characteristics:

Brookfield Viscosity at 25° C.=100–150 Pa.s

Flash point=58° C.;

Solvent=DMF;

and the following mechanical properties of the obtained polyurethane film:

modulus 100%=260 Kg/cm$^2$;

modulus 300%=130 Kg/cm$^2$;

ultimate tensile strength=500 to 570 Kg/cm$^2$

% ultimate elongation=290 to 500% and the following final properties after evaporation of the solution solvents: excellent resistance to abrasion and to solvents, exceptional resistance to hydrolysis and high viscosity.

The solutions B and C (obtained from the bases Vithane 160 and Vithane 168), having a 38% of dry substance (polyurethane), present the following characteristics:

Brookfield Viscosity at 25° C.=30–50 Pa.s

Flash point=58° C.;

Solvent=DMF;

and the following mechanical properties of the obtained polyurethane film:

modulus 100%=40 Kg/cm$^2$;

modulus 300%=60 Kg/cm$^2$;

ultimate tensile strength=250 Kg/cm$^2$

% ultimate elongation=800% and the following final properties after evaporation of the solution solvents: excellent resistance to hydrolysis and to repeated bending even at low temperature and an extremely high elasticity.

The formulations of these solutions, researched and developed by the applicant and used in the production process of coagulation, are the following:

the formulation (A') comprises 80% of DMF, 18% of Vithane 182 and, as an additive, 2% of Vithane 162 (a commercial product by Morton S.p.A.), all the percentages being expressed as weight percentages referred to 100 Kg of total mixture.

The formulation (B') comprises 40% of DMF, 5% of $H_2O$, 50% of Vithane 168, 1% of Vithane 162 (a commercial product by Morton S.p.A.), 0.5% of Vithane CF (a commercial product by Morton S.p.A.), 0.5% of Vithane S-10 (a commercial product by Morton S.p.A.), 1%–3% of Vithane 160 and 2%–5% of microcellulose, all the percentages being expressed as weight percentages referred to 100 Kg of total mixture.

The formulation (C') comprises 36% of DMF, 5% of $H_2O$, 1% of Vithane 162 (a commercial product by Morton S.p.A.), 0.3% of Vithane CF (a commercial product by Morton S.p.A.), 0.6% of Vithane S-10 (a commercial product by Morton S.p.A.), 10%–20% of Vithane 168, 10% of Vithane 160 and 2%–5% of microcellulose, all the percentages being expressed as weight percentages referred to 100 Kg of total mixture.

The formulations (B') and (C') contain a percentage of dry substance (polyurethane resin) equal to 20%.

In particular the support for the coagulation according to the present invention, packed into industrial rolls and placed on trolleys that allow continuous working, is placed at the starting point of a coagulation plant. From that point, according to a classical process of industrial coagulation, it passes without interruption into a first tank containing a polyurethane solution with the (A') formulation, as previously defined, for a first phase of pre-impregnation of the support. Once that the solution of polyurethane resin present in the bath, having the established formula, is absorbed, the pre-impregnated support comes out. During this first phase, both the warp and the weft of the support are coated with a precise and reproducible amount of polyurethane resin in solution (wet phase), forming a single body of smooth aspect.

Then, the pre-impregnated support enters the second working phase during which a steel-blade spreads a polyurethane solution of the (B') or (C') formulation on the pre-impregnated support. The new layer of wet substance becomes homogeneous with the pre-impregnated support and forms a single body with it.

This technique of coagulation is known as "wet by wet" and it makes the coagulated product more homogeneous and compact than the products obtained through other conventional techniques of coagulation.

The fabric, impregnated and spread with polyurethane resins, is sent to the coagulation tank, wherein the concentration water/DMF and the temperature are pre-fixed and constantly regulated through electronic control devices in order to obtain a product, having constant and reproducible characteristics.

Inside the tank, the process of coagulation of the coating on the support takes place, the polyurethane resins solidify, the DMF remains in the solution and the fabric, which is wet because of the presence of water and residues of DMF, goes through an additional treatment first in a suction station and then in a drying oven.

The coagulated product that comes out from the oven presents a solid and compact surface.

When the coagulated product is obtained starting from a support for coagulation according to the present invention of the type "double panama" and it is impregnated and coagulated through the "wet by wet" technique, it presents the following final characteristics:

total weight of the coagulated fabric: 1000 g/m$^2$ ±5% thickness: between 2.10 and 2.30 mm;

composition on dry base:

support of from 60% to 70%;

coagulated polyurethane resins of from 30% to 40%;

this coagulated product is also capable of absorbing an amount of solutions or water equal to 2 times its own weight or mass per square meter, and it is made using formulations (A'), (B') or (C') depending on its destination field.

When, on the contrary, the coagulated product is obtained starting from a support for coagulation according to the present invention of the type "herringbone 3:1" and it is impregnated and coagulated through the "wet by wet" technique, it presents the following characteristics:

total weight of the coagulated fabric: 950 g/m$^2$ ±5%;

thickness: between 1.90 and 2.10 mm;

composition on dry base:

support of from 65% to 75%;

coagulated polyurethane resins of from 25% to 35%;

this coagulated product is also capable of absorbing an amount of solutions or water equal to 2.5 times its own weight or mass per square meter.

In particular, the so obtained coagulated product can be used in different industrial fields, either directly or after additional finishing treatments of spreading with polyurethane resins.

The product coagulated according to the present invention can be used in the field of the work footwear and of the accident-prevention footwear as a transpiring/absorbing vamp, also water/oil-repellent. The coagulated product used in these fields has a thickness ranging of from 2.00 mm to 2.20 mm and a weight ranging of from 950 to 1000 g/m$^2$.

Furthermore, said coagulated product can be used in the field of the sport and leisure footwear (golf, riding, trekking, orthopaedic shoes, sanitary shoes, etc.), as a transpiring/impermeable vamp, also water/oil-repellent. The coagulated product used in these fields has a thickness ranging of from 1.90 mm to 2.10 mm and a weight ranging of from 900 to 1000 g/m$^2$.

The same product can be used as outer covering for seats in the field of furnishing and of industrial coatings (cars, industrial vehicles, trains, aeroplanes, etc.), having characteristics of transpiration, resistance to hydrolysis and being dirt-repellent. The coagulated product for these uses has a thickness ranging of from 2 mm ±5% and a weight of 900 g/m$^2$ ±5%.

All the above mentioned products can undergo finishing treatments to achieve the wished colour and aspect, according to their final utilisation.

The main advantage of the support obtained according to the present invention, as already indicated, consists in the possibility of getting a coagulated product having a high thickness, characterized by having a high degree of transpiration to steam and of body perspiration, by being waterproof, by presenting excellent resistance to solvents and to processes of rapid ageing (hydrolysis), which can be caused by chemical agents, by being oleo-repellent and dirt-repellent.

I claim:

1. Textile material especially suitable for the preparation of a coagulation support for resins, comprising a warp including from 8 to 10 polyester yarns per centimeter, said warp yarns presenting a count of 12/5 and a value of T.P.M. (Turns per meter) comprised between 200 and 220, and a weft including from 12 to 16 cotton yarns per centimeter, said weft yarns presenting a count of 12/6 and a value of T.P.M. comprised between 130 and 160, said textile material having a thickness ranging from 1.38 mm to 1.53 mm.

2. Textile material as claimed in claim 1, wherein the warp yarn presents a T.P.M. value of 207 and the weft yarn presents a T.P.M. value of 157.48.

3. Textile material as claimed in any of the previous claims, wherein its thickness ranges of from 1.47 mm to 1.53 mm, and its weft includes 14 to 16 cotton yarns per centimeter.

4. Textile material as claimed in claim 1, wherein the polyester yarn of the warp presents an ultimate tensile strength value of 4100 g and an ultimate elongation value of 33% and the cotton yarn of the weft presents an ultimate tensile strength value of 3000 g and an ultimate elongation value of 10%.

5. Textile material as claimed in claim 1, comprising a double panama weave pattern having a weight of 700 g/m$^2$ ±5%, and cotton in a percentage of from 65% to 73% and polyester in a percentage of from 35% to 27%.

6. Textile material as claimed in claim 1 or 2, wherein the thickness ranges from 1.38 mm to 1.42 mm and its weft includes 12 to 14 cotton yarns per centimeter.

7. Textile material as claimed in claim 6, comprising a "herringbone 3:1" pattern having a weight of 650 g/m$^2$ ±5%, cotton in a percentage of from 61% to 71% and polyester in a percentage of from 39% to 29%.

8. Coagulated product obtainable through wet-by-wet coagulation of polyurethane resins, having a polyurethane content of from 25% to 38%, on the textile support of claim 1.

9. Coagulated product as claimed in claim 8, having a thickness ranging of from 2.1 mm to 2.3 mm.

10. Coagulated product as claimed in claim 8, wherein the total weight of the coagulated fabric is 1000 g/m$^2$ ±5% and the thickness varies between 2.10 mm and 2.30 mm.

11. Coagulated product as claimed in claim 10, wherein the textile support is present in a percentage of from 60% to 70% and the coagulated polyurethane resins in a percentage of from 30% to 40%.

12. Coagulated product as claimed in claim 10, which is capable of absorbing an amount of polyurethane solutions or water equal to 2 times its own weight or mass per square meter.

13. Coagulated product as claimed in claim 8, wherein the total weight of the coagulated product is 950 g/m$^2$ ±5% and its thickness varies from 1.90 mm to 2.10 mm.

14. Coagulated product as claimed in claim 13 wherein the textile support is present in a percentage of from 65% to 75% and the coagulated polyurethane resins in a percentage of from 25% to 35%.

15. Coagulated product as claimed in claim 13, which is capable of absorbing an amount of polyurethane solutions or water equal to 2.5 times its own weight or mass per square meter.

16. Coagulated product as claimed in claim 8, which has a thickness ranging from 2.00 mm to 2.20 mm and a weight ranging from 950 g/m$^2$ to 1000 g/m$^2$.

17. Coagulated product as claimed in claim 8, which it has a thickness ranging from 1.90 mm to 2.10 mm and a weight ranging from 900 g/m$^2$ to 1000 g/m$^2$.

18. Coagulated product as claimed in claim 8, which it has a thickness of 2 mm ±5% and a weight of 900 g/m$^2$ ±5%.

19. Footwear having improved transpiration, water-impermeability and oil and water repellency made from the coagulated product of claim 8.

20. A seat covering having improved transpiration, dirt-repellency and hydrolysis resistance manufactured from the coagulated product of claim 8.

21. An industrial coating of improved transpiration, dirt-repellency and hydrolysis resistance manufactured from the coagulated product of claim 8.

22. A process of preparing a coated product which comprises applying a polyurethane resin coating composition to the textile material of claim 1 and coagulating the resin while on the textile.

* * * * *